US005697241A

United States Patent [19]

Djumlija et al.

[11] Patent Number: 5,697,241

[45] Date of Patent: Dec. 16, 1997

[54] ROLLING ARRANGEMENT

[75] Inventors: Gerlinde Djumlija, Ansfelden; Friedrich Moser, St. Florian; Johann Oberhumer, Unterweitersdorf; Heinrich Pühringer, Traun; Klaus Zeman, Linz, all of Austria

[73] Assignee: Voest-Alpine Industrieanlagenbau GmbH, Linz, Austria

[21] Appl. No.: 563,514

[22] Filed: Nov. 28, 1995

Related U.S. Application Data

[63] Continuation of Ser. No. 286,794, Aug. 5, 1994, abandoned.

[30] Foreign Application Priority Data

Aug. 23, 1993 [AT] Austria ..... 1697/93

[51] Int. Cl.[6] ..... B21B 45/04; B21B 45/02; B21C 43/00

[52] U.S. Cl. ..... 72/39; 72/40

[58] Field of Search ..... 72/201, 250, 39, 72/43, 40, 236; 29/81.08

[56] References Cited

U.S. PATENT DOCUMENTS

| | | | |
|---|---|---|---|
| 2,648,241 | 8/1953 | Bores | 29/81.08 |
| 3,420,083 | 1/1969 | Safford et al. | 72/201 |
| 3,510,065 | 5/1970 | Gigantino et al. | 29/81.08 |
| 3,740,989 | 6/1973 | Petros | 72/250 |
| 3,811,305 | 5/1974 | Saylor, Jr. | 72/39 |
| 4,793,168 | 12/1988 | Kimura | 29/81.08 |
| 4,962,657 | 10/1990 | Svagr | 72/250 |

FOREIGN PATENT DOCUMENTS

| | | |
|---|---|---|
| 0241919 | 10/1987 | European Pat. Off. . |
| 0586823A2 | 3/1994 | European Pat. Off. . |
| 811831 | 8/1951 | Germany . |
| 2165944 | 8/1972 | Germany . |
| 0231877 | 8/1987 | Germany . |
| 430231A1 | 8/1994 | Germany . |
| 4328303A1 | 6/1995 | Germany . |
| 8900012 | 1/1989 | Netherlands . |

*Primary Examiner*—Lowell A. Larson
*Assistant Examiner*—Rodney Butler
*Attorney, Agent, or Firm*—Hopgood, Calimafde, Kalil & Judlowe

[57] ABSTRACT

There is disclosed a rolling arrangement including a rolling stand and a preceding descaling means. In order to obtain a perfect surface quality while maintaining a high energy content of the rolling stock the descaling means is arranged immediately in front of the rolls of the rolling stand and is formed by a rotor descaling means. The liquid jets emerging from the rotor descaling means and impinging on the rolling stock are directed opposite to the rolling direction. The liquid impinging on the point of impact of the liquid jet on the surface of the rolling stock, after impingement has a flow resultant which—projected on the rolling direction—has a component opposite to the rolling direction.

17 Claims, 2 Drawing Sheets

Figure 1:
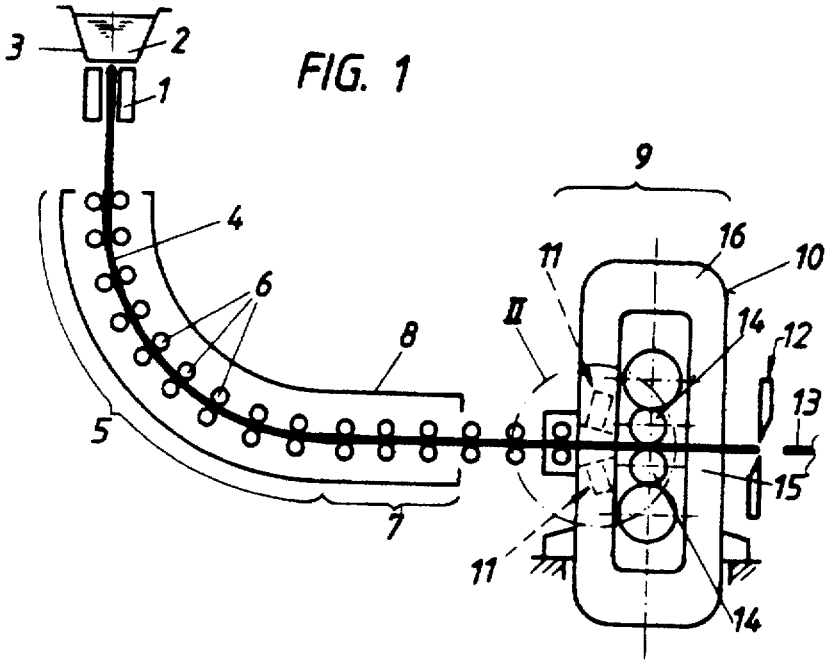

3
2
1
4
6
5
7
8
9
10
11
12
13
14
15
16
II 15
15
11
β
23
17
19
20
29
24
28
6
25
21
26
27
25
14
18
30
31
22
17
21
24
4
23
α

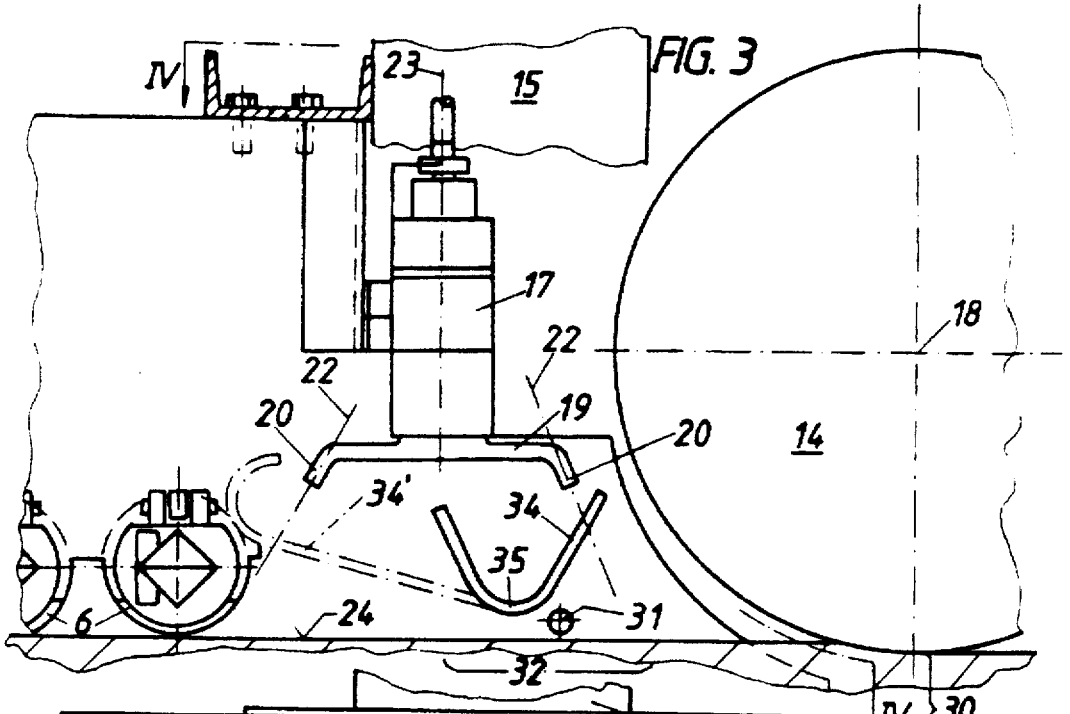
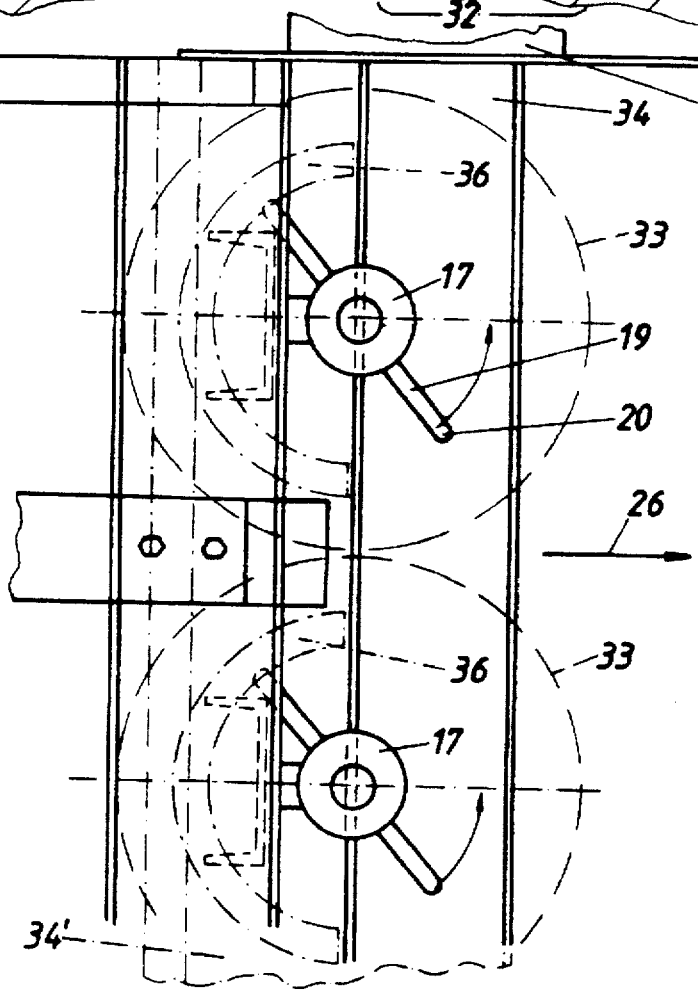
FIG. 4

ROLLING ARRANGEMENT

This is a continuation of application Ser. No. 08/286,794, filed Aug. 5, 1994 now abandoned.

The invention relates to a rolling arrangement comprising a rolling stand and a preceding descaling means.

From DE-C-41 34 599 it is known for the purpose of avoiding surface defects on the rolling stock, such as peelings or denudations, to spray cooling liquid on the rolling stock and on the jackets of the working rolls at the entry side of the rolling stock in a region extending over the entire width of the rolling stock as closely as possible in front of the rolling gap. Thereby, heavy cooling in a very thin external zone only, of the rolling stock is to be achieved such that cooling will not be critical to subsequent forming.

The arrangement provided for carrying out the cooling method according to DE-C-41 34 599 comprises spraying nozzles arranged at a larger distance from the rolls of the rolling stand and by means of which coolant is sprayed obliquely against the surface of the rolling stock directly in the direction towards the rolling gap such that part of the coolant jet impinges on the surface of the rolling stock and part of it impinges on the surfaces of the rolls. This involves the danger of scales chipping off, which scales cannot be prevented from entering the rolling gap thus possibly causing surface defects.

From EP-A-0241 919 and from U.S. Pat. No. 5,001,915 it is known for the hot rolling of rolling stock to remove the scales of the rolling stock by spraying on cooling water, the cooling water being sprayed on the surfaces of the rolling stock in a counter-movement relative to the movement of the rolling stock by means of nozzles provided on a cooling beam extending transversely over the rolling stock.

A particular problem arises with rolling arrangements incorporated in a continuous casting plant for on-line rolling of a cast strand, in particular at the rolling stand that is arranged first viewed in the casting direction, which is arranged in front of, or closely behind, the region of complete solidification of the cast strand. Because of the relatively high temperatures of the cast strand prevailing at the exit from the cooling chamber enclosing the secondary cooling zone of the strand guide, because Of the low forming speeds due to the relatively low advancing speed (=casting speed) of the rolling stock, i.e., of the cast strand, and because of the low deformation strength of the cast structure of the cast strand, such a rolling arrangement is easy and inexpensive to construct, since only relatively low rolling forces occur. Also only relatively little driving power is required such that the energy expenditures involved are low as compared to the degree of deformation.

However, as has been shown that the scales must be completely removed in front of such a rolling stand integrated in a continuous casting plant in order to obtain perfect surfaces, which, however, involves problems inasmuch as only a slight amount of liquid is to be used for removing the scales in order to keep the energy content of the cast strand as high as possible which runs counter the requirement of a complete removal of the scales. This holds in particular if only a thin cast strand, such as a strip-shaped strand having a thickness ranging between 20 and 80 mm, is cast.

According to EP-A-0 241 919 a descaling means as is known from rolling mill technology—for instance, from U.S. Pat. No. 5,001,915—is provided for the on-line rolling of a cast strand. However, it has been proved that large amounts of water must be sprayed on the cast strand in order to achieve efficient descaling, which involves a relatively high temperature decrease of the cast strand, in particular, of its surface regions, such that the descaling method known from rolling mill technology cannot be realized without disadvantages for the descaling of cast strands rolled on-line, in particular, due to the very low rolling speed (=casting speed).

Therefore, the invention has as its object to provide a rolling arrangement comprising a rolling stand and a preceding descaling means, which meet with the diverging demands of a perfect surface quality by the complete removal of scales and of as slight an amount of liquid applied as possible.

In accordance with the invention, this object is achieved in that the descaling means comprises a rotor descaling means arranged immediately in front of the rolls of the rolling stand.

wherein the liquid jets emerging from the rotor descaling means and impinging on the rolling stock are directed opposite to the rolling direction and the liquid impinging on the point of impact of the liquid jet on the surface of the rolling stock, after impingement, has a flow resultant which—projected on the rolling direction—has a component opposite in direction to the rolling direction.

The rotor descaling means, in the first place, acts by mechanically removing the scales. This removal is promoted by the scales being chilled by the liquid jets, the scale skin, thus breaking open. To assist in the breaking open of the scale skin, a mechanical scale breaking means, such as a bending means, advantageously may be provided upstream of the rotor descaling means.

Rotor descaling means are known per se. for instance, from DE-A-31 25 146 for the descaling of hot steel ingot. Thereby a spraying beam extending across the total width of the steel ingot parallel to its surface is set in rotation about an axis directed perpendicular to its longitudinal extension.

It has been shown that by the use of a rotor descaling means according to the invention, substantially less amounts of water will do than with conventional descaling plants as are known, for instance. from the initially mentioned DE-C -41 34 599 as well as from U.S. Pat. No. 5,001,915 and from EP-A -0 241 919, respectively, such that only a very small portion of its calorie content is withdrawn from the rolling stock. e.g., a cast strand. Thereby it is also possible to feed to the rolling stand very thin rolling stock still having a very high content of energy. By arranging the descaling means immediately in front of the rolls of the rolling stand it is, furthermore, possible to efficiently minimize secondary scaling to an extent that is no longer disturbing.

Preferably, the planes laid or passing through the axes of the liquid jets and parallel to an axis of one of the rolls of the rolling stand always enclose an acute angle with the rolling direction laid on the surface of the rolling stock at the point of impact of the liquid jet, the vertex of which angle is directed opposite to the rolling direction.

According to a preferred embodiment, which renders feasible a particularly simple mode of construction of the descaling means, the rotor axis(es) of the rotor descaling means is/are arranged in a manner inclined relative to the surface of the rolling stock, the angle of inclination of the rotor axis relative to a straight line oriented perpendicular to the surface of the rolling stock suitably being larger than the angle enclosed by the axis of a liquid jet with the rotor axis.

Positioning of the descaling means particularly closely in front of the rolls of the rolling stand may be achieved if a partial region of the spraying region produced by the liquid jets of the rotor descaling means is shielded off relative to the surface of the rolling stock.

According to, a sturdy and cost-saving embodiment, a cover sheet or shroud including a liquid draining channel and extending across the surface of the rolling stock suitably is provided for shielding off this partial region.

In doing so, the cover sheet advantageously covers a spraying region directed against the rolling gap of the rolling stand, viewed in ground section.

In order to comply with the particularly narrow space conditions immediately closely in front of the rolls, of the rolling stand, in particular with thin rolling stock, the cover suitably is provided with a rolling stock capturing or guiding means directed opposite to the rolling direction for safely introducing the front end of the rolling stock into the rolling gap, which capturing and guiding means advantageously is comprised of a plate panel extending parallel to one of the axes of the rolls of the rolling stand and in which at least one recess is provided for the passage of the liquid jets emerging from the rotor descaling means.

Therein, it is, furthermore, advantageous to design the recess in the form of an annulus section.

A particularly important embodiment is characterized in that the rolling stand is adapted for the rolling of a cast strand, in particular, a thin strand, the rolling stand advantageously being integrated in a continuous casting plant.

The rolling arrangement according to the invention allows for the rotor descaling means to be arranged within the rolling housing of a robing stand.

For particularly wide cast strands, the rotor descaling means suitably comprises two or several rotor heads adjacently arranged approximately parallel to the axes of the rolls of the rolling stand.

To remove scales that happen to get near the rolling gap due to the formation of whirls, a chess spraying means is provided according to a preferred embodiment in the immediate region of entry of the rolls of the rolling stand, the cross spraying means preferably being provided between the cover sheet and the surface of the rolling stock in case a spraying region cover sheet is provided.

Figure 2:
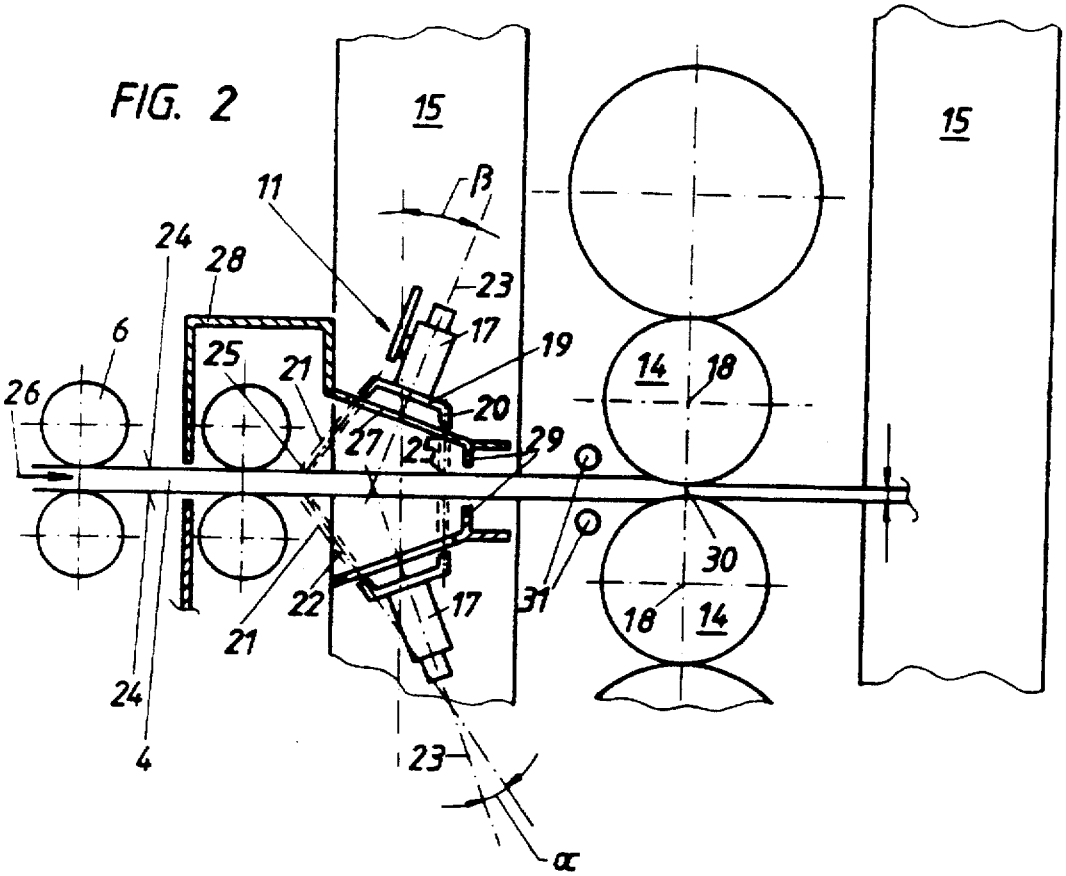

In the following, the invention will be explained in more detail by way of two exemplary embodiments, wherein FIG. 1 represents a continuous casting plant schematically illustrating an integrated rolling arrangement in side view, FIG. 2 shows a detail II of FIG. 1 on an enlarged scale according to a first embodiment, FIG. 3 represents a second embodiment in an illustration analogous to FIG. 2, and FIG. 4 is a view along line IV—IV of FIG. 3.

A cooled continuous casting mold denoted by 1 is fed with molten steel 2 supplied from a tundish 3. The cast strand 4 forming in the mold 1, having a liquid core and an initially thin strand skin is diverted into the horizontal strand guide 7 via an arcuately designed strand supporting means 5 which is equipped with closely adjacent supporting rollers 6. The arcuately designed strand supporting means 5 and the first pan of the horizontal strand guide 7 are surrounded by a cooling chamber 8 containing the secondary cooling zone.

After emergence of the cast strand 4 from the cooling chamber 8, the cast strand (which has a thickness of about 60 mm) is conveyed to a rolling arrangement 9 (in which it is reduced to a thickness of about 40 mm) comprised of a rolling stand 10 and a preceding descaling means 11. Downstream of the rolling arrangement 9, a separating means comprising, for example, a pair of opposed cutting blades 12; is provided for separating the completely solidified and deformed cast strand 4 into slabs 13. If the cast strand 4 is further processed to thin strip, the separation is effected according to the coil weight desired. The separated slabs 13 (thin slabs when casting a thin strand) are supplied to a roller hearth furnace (not illustrated), in which the thin slabs are maintained at rolling temperature, or are heated to this temperature if necessary the roller hearth furnace also assuming the function of buffering the thin slabs in case of an accident. Rolling to thin strip subsequently is effected in a multi-stand finishing train not illustrated herein).

As is apparent from FIG. 2 the descaling means 11 is arranged immediately in front of the working rolls 14 of the rolling stand 10, i.e., in a region between the side cheeks 15 of the rolling housing 16. The descaling means 11 is designed as a rotor descaling means, the number of rotor heads 17 of the rotor descaling means 11 being chosen in accordance with the width of the cast strand 4. If several rotor heads 17 are provided, they are adjacently arranged in a plane extending parallel to the axes 18 of the working rolls 14 of the rolling stand 10(cf. FIG. 4).

Each rotor head 17 comprises at least one rotating spraying arm 19 preferably designed as a radially extending double spraying arm 19 on the ends of which spraying on whose ends spraying, on whose ends nozzles 20 are arranged. Instead of the spraying arm 19, a rotating disc may be provided, on whose periphery spraying nozzles are arranged. The axes 22 of the liquid jets 21 emerging from the spraying nozzles 20 enclose an acute angle $\alpha$ with the rotor axis 23 of the pertaining rotor head 17. As is apparent from FIG. 2, the rotor axes 23 of the rotor heads 17 are arranged to be inclined relative to the rolling stock surface 24 (=surface 24 of the cast strand 4), the angle of inclination $\beta$ of the axes of rotation 23 of the rotor heads 17 relative to the vertical being larger than the angle $\alpha$ enclosed by the axes 22 of the liquid jets 21 with the rotor axes 23 of the rotor heads 17. Thereby, it is ensured that the planes laid or passing through the axes 22 of the liquid jets 21 and parallel to one of the axes 18 of the working rolls 14 of the rolling stand 10 each always enclose an acute angle with the rolling direction 26 laid at the point of impact 25 of the liquid jet 21 on the surface 24 of the cast strand 4. the vertex of which angle is directed opposite to the rolling direction 26.

Thereby the liquid impinging on the plaint of impact 25 of the liquid jet 21 on the surface 24 of the cast strand 4 is caused to have a flow resultant after impingement, which projected on the rolling direction 26, has a component opposite in direction to the rolling direction 26, the flying direction of the chipping off scales, thus, being oriented opposite to the rolling direction.

In order to avoid spraying water, the liquid jets 2 enter a casing or shroud 28 coveting the surface 24 of the cast strand 4 in the region of the descaling means 11 through an opening 27 immediately upon emergence from the spraying nozzles 20. This casing 28 is provided with a shielding wall 29 opposite the rolling gap 30 formed by the working rolls 14 such that almost no spraying water can be whirled against the rolling gap 30.

In the immediate drawing-in region of the working rolls 14 of the rolling stand another cross spraying means 31 is provided, which enables the removal of scale particles possibly whirling around. This cross spraying means 31 also strongly reduces secondary scaling on account of backheating which might occur due to the very slight amount of liquid applied by the rotor descaling means 11.

According to the embodiment illustrated in FIG. 3, the rotor heads 17 are arranged with their rotor axes 23 located perpendicular to the surface 24 of the cast strand 4, as a result of which the liquid jets 21 would be directed against the rolling gap 30 over a partial region 32 of the circle of impact 33 formed by the liquid jets 21. In order to prevent the liquid jets 21 from impinging on the surface 24 of the cast strand 4 in this region 32, a shielding is provided in this region 32, which is formed by a cover sheet 34 extending across the surface 24 of the cast strand 4. This cover sheet 34 comprises a liquid draining channel 35 letting off the liquid collecting on this cover sheet 34.

To safely introduce the rolling stock into the rolling gap 30—which is of particular importance with thin strand—a capturing and guiding means is provided according to a preferred embodiment, which is illustrated in dot-and-dash lines in FIGS. 3 and 4 and which is formed by a sheet panel 34' extending parallel to one of the axes 18 of the working rolls 14 of the rolling stand 10. This sheet panel 34' is integrally designed with the cover sheet 34, including recesses 36 in the form of partial annuli for the passage of the liquid jets 21 emerging from the spraying nozzles 20.

The number of spraying nozzles 20 per rotor head 17 may be chosen as a function of the amount of liquid required. The number of revolutions of the spraying arms 19 is controlled as a function of the casting speed. i.e., as a function of the drawing-in speed of the cast strand 4 into the rolling stand 10. Preferably, the liquid is sprayed at a pressure of between 200 and 500 bar.

What we claim is:

1. In a rolling arrangement adapted for rolling, in a rolling direction, rolling stock having a rolling stock surface, said arrangement including a rolling stand accommodating rolls having roll axes, said rolls defining a rolling gap therebetween, and a descaling means preceding said rolling stand, the improvement wherein said descaling means is comprised of a rotatably mounted descaling device arranged immediately in front of said rolls of said rolling stand and adapted to issue liquid jets from said spray nozzles, each formed by a cooling liquid, which liquid jets, emerging from said rotatably mounted descaling device and impinging on said rolling stock surface on a point of impact, are directed opposite to said rolling direction while said device is continually rotated through a number of revolutions, and wherein said cooling liquid, after impinging on said rolling stock surface at said point of impact of said liquid jet, has a flow resultant which when projected on said rolling direction provides flow components consisting essentially of those opposite in and transverse to the direction of said rolling direction.

2. A rolling arrangement as set forth in claim 1, wherein each of said liquid jets is characterized by a liquid jet axis, and wherein a plane passing through said liquid jet axis and parallel to one of said roll axes forms an acute angle with said rolling direction at said point of impact of a liquid jet on said rolling stock surface, said acute angle having a vertex directed opposite to said rolling direction.

3. A rolling arrangement as set forth in claim 1, wherein said rotatably mounted descaling device comprises at least one rotor axis inclined relative to said rolling stock surface.

4. A rolling arrangement as set forth in claim 1, wherein said liquid jets issued from said rotor descaling device produce a spraying region, and wherein said spraying region including a partial spraying region is shielded off relative to said rolling stock surface.

5. A rolling arrangement as set forth in claim 1, wherein said rolling stand is adapted for rolling a cast strand.

6. A rolling arrangement as set forth in claim 1, wherein said rolling stand comprises a rolling housing and said rotor descaling device is disposed within said rolling housing.

7. A rolling arrangement as set forth in claim 1, wherein said rotor descaling device comprises at least two rotatably mounted rotor heads adjacently arranged approximately parallel to said roll axes of said rolls of said rolling stand.

8. A rolling arrangement as set forth in claim 1, further comprising a cross spraying means arranged in the immediate region of entry of said rolls of said rolling stand.

9. A rolling arrangement as set forth in claim 3, wherein each of said liquid jets has a liquid jet axis enclosing an acute angle with said at least one rotor axis and said at least one rotor axis forms an angle of inclination relative to a straight line directed perpendicular to said rolling stock surface, said angle of inclination being larger than said acute angle enclosed by said liquid jet axis with said at least one rotor axis.

10. A rolling arrangement as set forth in claim 4, further comprising a cover sheet including a liquid draining channel and extending across said rolling stock surface to shield off said partial spraying region.

11. A rolling arrangement as set forth in claim 10, wherein said partial spraying region covered by said cover sheet is directed against said rolling gap of said rolling stand, viewed in ground section.

12. A rolling arrangement as set forth in claim 11, further comprising a rolling stock capturing or guiding means provided on said cover sheet and directed opposite said rolling direction, said rolling stock capturing or guiding means being adapted to safely introduce said rolling stock by its front end to said rolling gap.

13. A rolling arrangement as set forth in claim 12, wherein said rolling stock capturing or guiding means is comprised of a sheet panel extending parallel to one of said roll axes of said rolls of said rolling stand, said sheet panel including at least one recess for said liquid jets emerging from said rotor descaling means to pass therethrough.

14. A rolling arrangement as set forth in claim 13, wherein said recess is designed as an annulus section.

15. A rolling arrangement as set forth in claim 5, wherein said cast strand is a thin strand.

16. A rolling arrangement as set forth in claim 5, wherein said rolling stand is cooperatively integrated with a continuous casting plant.

17. A rolling arrangement as set forth in claim 8, further comprising a spraying region cover sheet, and wherein said cross spraying means is provided between said spraying region cover sheet and said rolling stock surface.

* * * * *